United States Patent [19]

Focke

[11] 4,142,406

[45] Mar. 6, 1979

[54] TEST APPARATUS FOR CIGARETTE PACKING MACHINES

[75] Inventor: Heinz Focke, Verden Aller, Fed. Rep. of Germany

[73] Assignee: Focke & Pfuhl, Verden, Fed. Rep. of Germany

[21] Appl. No.: 850,317

[22] Filed: Nov. 10, 1977

[30] Foreign Application Priority Data

Jan. 6, 1977 [CA] Canada ..... 174339

[51] Int. Cl.[2] ..... G01N 3/42

[52] U.S. Cl. ..... 73/819; 73/81; 209/536

[58] Field of Search ..... 73/78, 81, 94, 141 AB; 209/79, 109; 131/21 C

[56] References Cited

U.S. PATENT DOCUMENTS

| | | | |
|---|---|---|---|
| 3,368,674 | 2/1968 | Koeppe | 73/94 X |
| 3,703,235 | 11/1972 | McEnery | 209/79 |
| 3,874,227 | 4/1975 | Focke | 73/94 |

*Primary Examiner*—Charles Gorenstein

*Attorney, Agent, or Firm*—Sughrue, Rothwell, Mion, Zinn and Macpeak

[57] ABSTRACT

A machine for testing the presence and/or packing of cigarettes (11) in a group (10) comprises a housing 16 mounting a plurality of spring biased, axially displaceable tappets (13), (14) and (15) arranged in rows corresponding to the cigarette group alignment. Each row of recesses (25) for the tappet control heads (22) is provided with a pair of linear control ducts (27), (40); (28), (41); (29), (42) axially displaced relative to the tappets. If a tappet is fully displaced by engagement with an acceptable cigarette the inner duct (27), (28) or (29) will be opened and the outer duct (40), (41) or (42) blocked, and the full spring return of a displaced tappet will open the outer duct and block the inner duct. The partial return of a tappet, as a result of particle jamming, will leave both ducts blocked, however, and generate an appropriate error signal, as will the complete non-return of a displaced tappet.

2 Claims, 4 Drawing Figures

TEST APPARATUS FOR CIGARETTE PACKING MACHINES

BACKGROUND OF THE INVENTION

This invention relates to a test apparatus for cigarette packing machines of the type having a plurality of spring biased, axially displaceable tappets adapted to engage the ends of a group of cigarettes and to detect, in response to the lack of a suitable displacement of one or more of said tappets, the presence of a missing or faulty (loosely packed) cigarette in said group.

The closest known prior art is exemplified by U.S. Pat. No. 3,874,227, as shown in FIGS. 1 and 2 of the drawings. The test apparatus 12 illustrated therein comprises a hollow housing 16 provided with a plurality of apertures for accommodating an equal plurality of tappets 13, 14 and 15 biased outwardly by springs 20. Each tappet has a contact head 19 adapted to be brought into engagement with a cigarette 11 in a group of cigarettes 10, and is provided at its distal end with a control head 22 accommodated, in a neutral or rest position, within a circular recess 25. A plurality of linear control ducts 27, 28 and 29 connect each row of recesses 25, and are provided with light transmitters 32, such as photoluminescent diodes, at their one ends and with light receivers 33, such as photo transistors, at their other ends. The ducts 27, 28 and 29 are eccentrically disposed relative to the longitudinal axes of the tappets 13, 14 and 15 so that the light control beams from the transmitters 32 are able to pass through to the receivers 33 when all of the control heads 22 in a given row are displaced. In operation, the housing 16 and projecting tappets are swung into contact with a "packed" group 10 of cigarettes 11, and if one or more the tappets fails to be axially displaced, as when a missing or loosely packed cigarette is encountered, one of the control ducts will remain blocked and its associated receiver 32 will not generate a group "acceptance" signal, whereby the tested group of cigarettes is rejected.

With the arrangement of the FIGS. 1 and 2, however, only one position of the tappets 13, 14 and 15 can be tested by means of the light rays passing through the control ducts 27, 28 and 29. The practical operation of a cigarette packaging machine gives rise to considerably quantities of dust, paper fibers, tobacco residues, etc., and experience has shown that these particles tend to lodge firmly in the corners, gaps, and the like of the apparatus. As a result, when the tappets are actuated by engagement with cigarettes and axially displaced against the pressure of springs 20, they may jam and fail to return to their initial positions (shown at 14 in FIG. 1). As is obvious, such return failure gives rise to faulty test results.

SUMMARY OF THE INVENTION

According to the present invention this drawback and disadvantage of the prior art is effectively overcome by providing a dual tappet position monitoring arrangement which effectively detects incorrectly positioned tappets and generates an error signal in response thereto. Specifically, each row of aligned tappet control head recesses is provided with a pair of linear control ducts axially displaced relative to the tappets. If a tappet is fully displaced by engagement with an acceptable cigarette the inner duct will be opened and the outer duct blocked, and the full spring return of a displaced tappet will open the outer duct and block the inner duct.

The partial return of a tappet, as a result of particle jamming, will leave both ducts blocked, however, and generate an appropriate error signal, as will the complete non-return of a displaced tappet.

DETAILED DESCRIPTION OF THE PREFERRED EMBODIMENT

Figure 1:
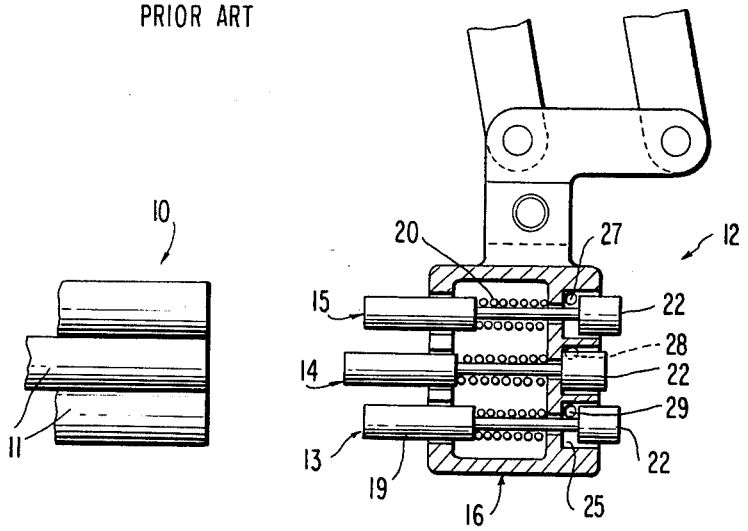
FIG. 1 PRIOR ART
FIG. 1 shows a cigarette testing device according to the prior art, in partial vertical section.
Figure 2:
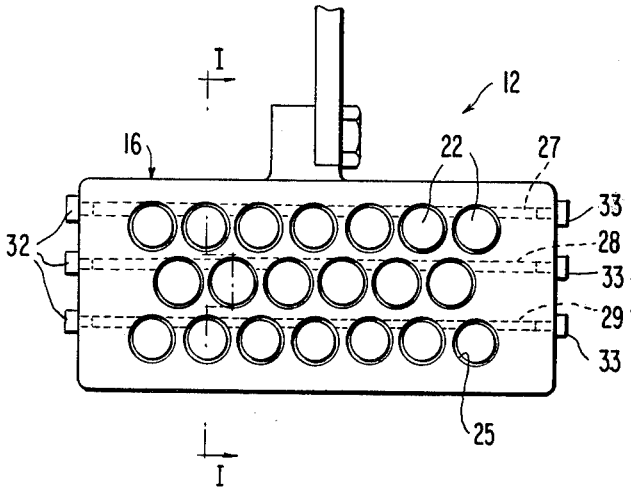
FIG. 2 PRIOR ART
FIG. 2 shows a rear view of the prior art testing device of FIG 1.
Figure 3:
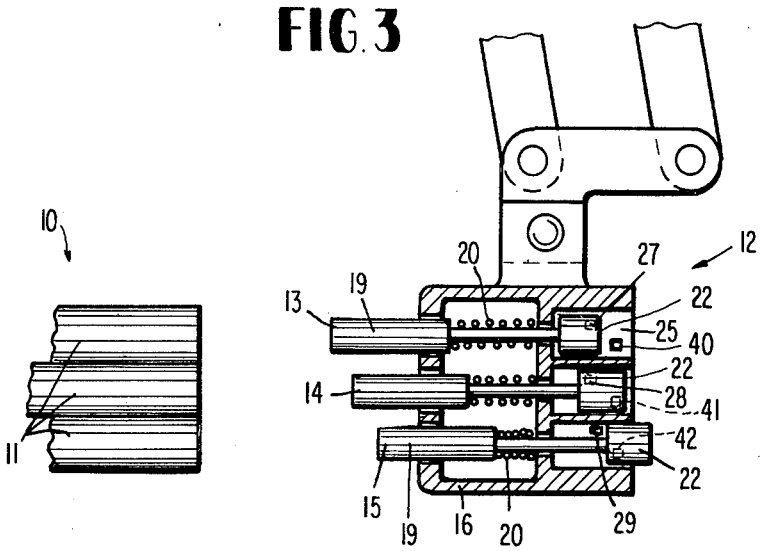
FIG. 3 shows a partial vertical sectional view of an improved cigarette testing device according to the present invention.
Figure 4:
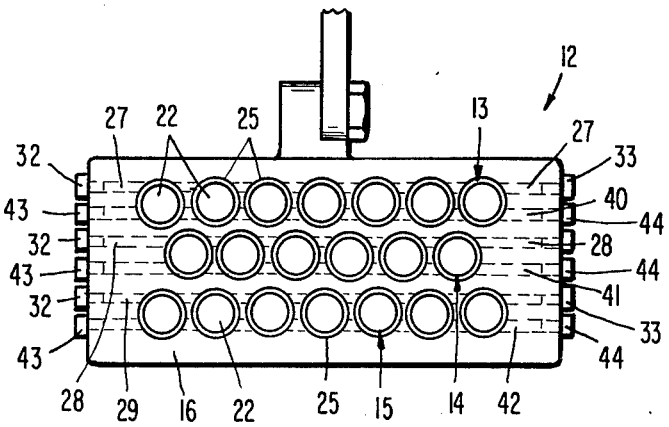
FIG. 4 shows a rear view of the testing device of FIG. 3.

The initial or neutral position of the tappets is that of tappet 13 in FIG. 3. With all of the tappets in this position the inner control ducts 27 are blocked by the control heads 22 of the respective tappets. When a group of cigarettes is being tested, if each cigarette is properly filled or packed each tappet is axially displaced to the position of tappet 15 in FIG. 3. This opens all of the inner control ducts 29, for example, and a corresponding acceptance signal can thus be produced by a ray of light passing through such opened duct.

In the present invention the housing 16 is provided, in the vicinity of recesses 25, with additional, outer control ducts 40, 41 and 42, one for each row of tappets 13, 14 and 15. These outer control ducts are similarly fitted at one end with light transmitters 43 and, at their opposite ends, with light receivers 44, e.g. with photoluminescent diodes and photo transistors, respectively. The outer control ducts 40, 41 and 42 are disposed in extensions of the recesses 25 and outside of the area of the tappet control heads 22 when the tappets are in their initial positions, as at 13. If, however, a particular tappet is prevented from returning to its initial position, as a result of particle jamming, for example, as is the case with tappets 14 and 15 in FIG. 3, then the rays of light in control ducts 41 and 42 are interrupted. This produces an appropriate "non-return" error signal, which disables the testing operation and/or alerts the machine operator to take the necessary corrective action. The relative locations of control ducts 40, 41 and 42 are such that even small, unwanted displacements of the tappets from their initial or start positions block these outer control ducts. The light transmitters 32, 43 can be energized and/or the light receivers 33, 34 enabled or their outputs approriately gated in sychonization with the displacement of the test apparatus toward and away from a group of cigarettes to be tested, in a known and obvious manner.

What is claimed is:

1. In a testing device for cigarette packing machines for simultaneously testing the ends of cigarettes disposed in a group and including a support housing having a plurality of apertures extending therethrough, a plurality of tappet means slidably disposed in said apertures, biasing means axially acting on said tappet means, at least one passage transversely intersecting the path of travel of each of said tappet means, and radiant energy source means and detector means respectively mounted at opposite ends of said passage for providing and receiving a radiant energy beam upon engagement of all of said tappet means with an acceptable group of cigarettes, said radiant energy beam being interrupted upon engagement of one or more faulty cigarettes by one or more of said tappet means, the improvement characterized by:

at least one additional transverse passage associated with the tappet means, said additional passage being disposed in the housing in the vicinity of the path of travel of the tappet means such that said additional passage is blocked by a tappet means displaced from its initial position.

2. A testing device as recited in claim 1, wherein each tappet means includes a tappet member and a control head connected to one end thereof, the support housing includes a plurality of open recesses for individually receiving each control head, the first-mentioned and additional passages pass through the recesses, the first-mentioned passages and said additional passage are arranged in relation to each other and to the different positions of the control heads such that, in the initial position of the tappet means, the first-mentioned passage is blocked whereas said additional passage is open, and in the displaced position of the tappet means the first-mentioned passage is open whereas said additional passage is blocked.

* * * * *